US006993426B2

(12) United States Patent
Hawkins

(10) Patent No.: US 6,993,426 B2
(45) Date of Patent: Jan. 31, 2006

(54) METHOD OF ENGINE OVERSPEED PROTECTION BY INHIBITING OPERATOR THROTTLE INPUT

(75) Inventor: Jeffery Scott Hawkins, Farmington Hills, MI (US)

(73) Assignee: Detroit Diesel Corporation, Detroit, MI (US)

( * ) Notice: Subject to any disclaimer, the term of this patent is extended or adjusted under 35 U.S.C. 154(b) by 0 days.

(21) Appl. No.: 10/618,937

(22) Filed: Jul. 14, 2003

(65) Prior Publication Data

US 2005/0015196 A1 Jan. 20, 2005

(51) Int. Cl.
*G06G 7/70* (2006.01)

(52) U.S. Cl. ..... 701/110; 701/102; 701/115; 123/321; 123/322; 123/323

(58) Field of Classification Search ..... 701/102, 701/110, 115; 123/321, 322, 323
See application file for complete search history.

(56) References Cited

U.S. PATENT DOCUMENTS

| | | | | |
|---|---|---|---|---|
| 4,090,114 | A | 5/1978 | Thompson | |
| 4,134,373 | A | 1/1979 | Kibler et al. | |
| 4,905,154 | A * | 2/1990 | Strong et al. | 701/93 |
| 5,020,361 | A * | 6/1991 | Malecki et al. | 73/118.1 |
| 5,353,762 | A * | 10/1994 | Dykstra et al. | 123/352 |
| 6,148,793 | A * | 11/2000 | Faletti et al. | 123/322 |
| 6,363,906 | B1 | 4/2002 | Thompson et al. | |
| 6,393,353 | B1 * | 5/2002 | Brocard et al. | 701/99 |
| 6,560,963 | B2 * | 5/2003 | Cornell et al. | 60/602 |
| 6,609,495 | B1 * | 8/2003 | Cornell et al. | 123/321 |

* cited by examiner

*Primary Examiner*—Tony M. Argenbright
*Assistant Examiner*—Johnny H. Hoang
(74) *Attorney, Agent, or Firm*—Brooks Kushman P.C.

(57) ABSTRACT

An engine control practices a method for engine control including detecting an overspeed indication selectively settable in the vehicle, responding to the threshold speed operation, and inhibiting response to the throttle control actuation when engine braking is desired. The engine braking may be enabled when said overspeed operation is maintained beyond its detection in combination with continued throttle actuation.

11 Claims, 3 Drawing Sheets

METHOD OF ENGINE OVERSPEED PROTECTION BY INHIBITING OPERATOR THROTTLE INPUT

BACKGROUND OF THE INVENTION

1. Field of the Invention

The present invention relates to control of compression ignition engines with electronic control modules programmable to detect engine overspeed operation, and inhibiting throttle response to throttle activation after detecting overspeed engine operation.

2. Background Art

A vehicle engine may be severely damaged when the engine is driven to an overspeed condition. Of course, the upper limit of the damaging overspeed condition may be different for a variety of engines, and often depends on the number of cylinders, or/and stroke of the cylinders, and other structural parameters of the vehicle engine. Typically engine brakes can be enabled to prevent an engine overspeed condition. Engine compression brake logic prohibits enabling the engine compression brakes whenever the engine is fueling. This is necessary to prevent possible engine or engine compression brake damage. Therefore, an engine overspeed condition may occur if throttle actuation is continued by an operator even though an engine overspeed threshold has already been reached by the engine.

Overspeed control may be particularly important where travel over different terrain may complicate operation of the vehicle. In particular, if an operator is driving a truck up hill, typically the throttle is being actuated to keep engine speeds and torque at a high level. After cresting the top of the hill, if the operator keeps his foot on the accelerator pedal, engine compression brakes will not enable, since the electronic engine controller inhibits engine brake activation while fueling the engine. Such a controller normally has been programmed into the controller since there are very few times that the operator would want to enable the engine brakes when the driver is requesting more power from the engine. However, after cresting on the top of the hill, the vehicle begins a downward descent and speed control would be desirable. Nevertheless, if the operator keeps his foot on the accelerator pedal, the vehicle will be unable to take advantage of engine braking, the normal resistence to displacement of the pistons in the cylinders, when the fueling level is inadequate to maintain the speed at which the engine is turning.

SUMMARY OF THE INVENTION

The present invention overcomes the abovementioned disadvantages by providing an electronic control system for an engine that can detect engine overspeed operation at a level selected to be undesirable and inhibiting response to a request for engine fueling. The response may be a generation of a signal that limits the engine speed below a threshold defined as undesirable. Moreover, the overspeed level may be programmed into the control or otherwise selected as desired to avoid an undesirable absence of engine braking when vehicle speed control is desirable.

In the preferred embodiment, an electronic engine controller, for example, an existing DDEC IV controller, that may be modified to use the existing overspeed digital output, is provided with a control that also has a throttle inhibit to enable the engine compressor brakes when an engine overspeed event occurs. According to the present invention, when the engine speed reaches a programmable overspeed threshold, a digital output is activated, for example, a switch to ground. The digital output is connected to a throttle inhibit digital input of the controller. In the preferred example, grounding the input enables the throttle inhibit function, to disable or override the throttle request being initiated by the operator. Such a control may be useful provided that the other criteria for engine brake operation are all satisfied. Nevertheless, other electronic controllers could be modified to include software logic that allows the engine to ignore fueling requests above a certain threshold engine speed, regardless of accelerator pedal position, thus allowing engine brake activation above a programmable engine speed. Also, a device could send an inhibit fueling message via a digital communication link such as SAE J1939 or SAE J1922 when the accelerator pedal actuation is to be ignored for purposes of engine compression braking.

BRIEF DESCRIPTION OF THE DRAWINGS

The present invention will be more clearly understood by reference to the following detailed description of a preferred embodiment when read in conjunction with the accompanying drawing, in which like reference characters refer to like parts throughout the views, and in which.

DETAILED DESCRIPTION OF THE PREFERRED EMBODIMENT

Figure 1:
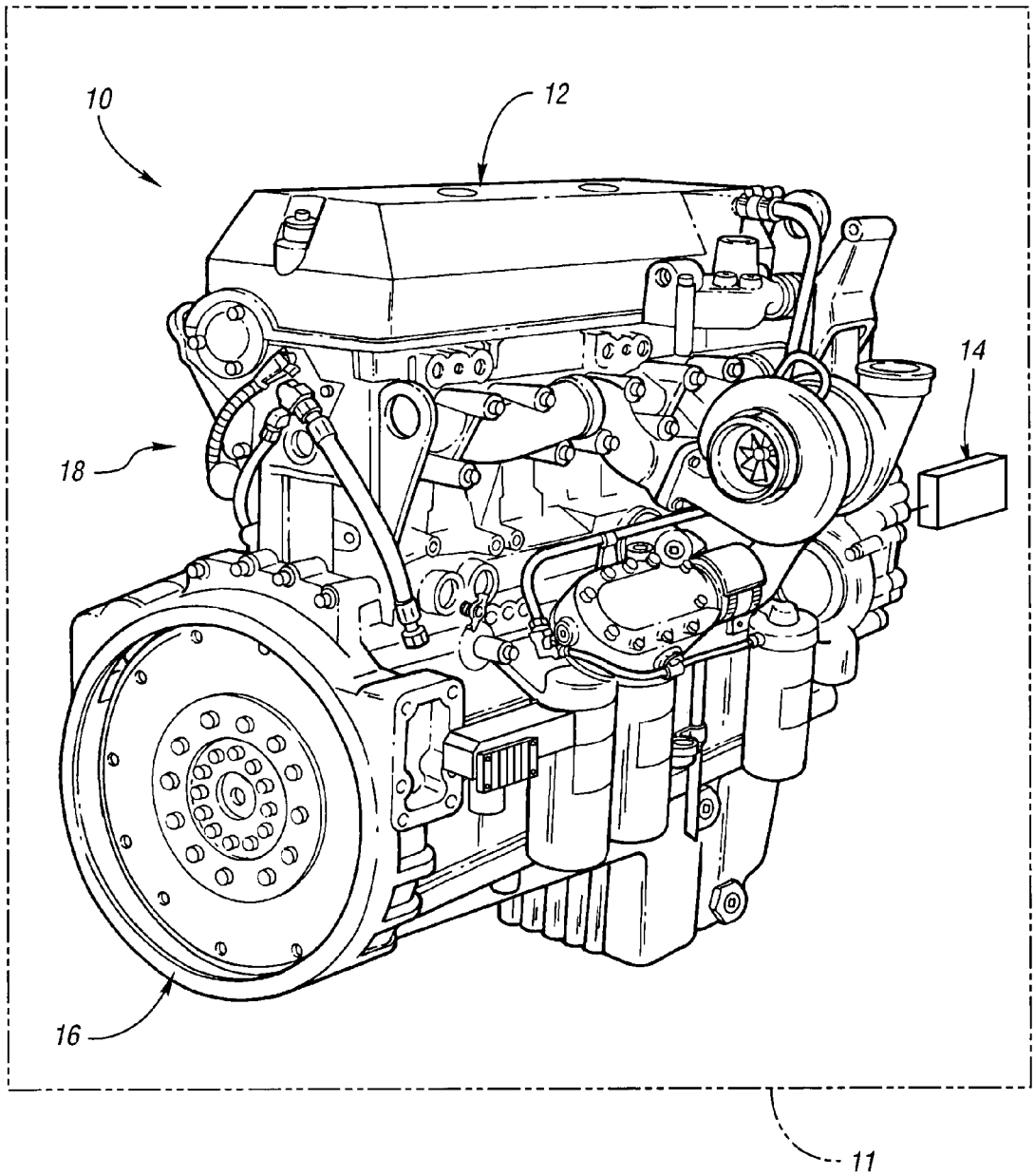
FIG. 1 is a diagrammatic view of a vehicle that includes a perspective view of an engine with an electronic control in accordance with the present invention.

FIG. 1 is a perspective view of a compression-ignition, internal combustion engine 10 incorporating various features of engine control according to the present invention. As will be appreciated by those of ordinary skill in the art, engine 10 may be used in a wide variety of equipment 11 for applications including on-highway trucks, construction equipment, marine vessels, and generators, among others. Engine 10 includes a plurality of cylinders disposed below a corresponding cover, indicated generally by reference numeral 12. In a preferred embodiment, engine 10 is a multi-cylinder compression ignition internal combustion engine, such as a 4, 6, 8, 12, 16, or 24 cylinder diesel engine, for example. Moreover, it should be noted that the present invention is not limited to a particular type of engine or fuel. However, the equipment is preferably a vehicle whose speed must be controlled by the engine or by the powertrain driving the vehicle.

Engine 10 includes an engine control module (ECM) 14. ECM 14 communicates with various engine sensors and actuators via associated cabling or wires, indicated generally by reference numeral 18, to form a controller 32 to control the engine and equipment 11. In addition, controller 32 communicates with the engine operator using associated lights, switches, displays, and the like as illustrated in greater detail in FIG. 2. When mounted in a vehicle, engine 10 is coupled to a transmission via flywheel 16. As is well known by those in the art, many transmissions include a power take-off (PTO) configuration in which an auxiliary shaft may be connected to associated auxiliary equipment which is driven by the engine/transmission at a relatively constant rotational speed using the engine's variable speed governor (VSG). Auxiliary equipment may include hydraulic pumps for construction equipment, water pumps for fire engines, power generators, and any of a number of other rotationally driven accessories. Typically, the PTO mode is used only while the vehicle is stationary. However, the present invention is independent of the particular operation mode of the engine, or whether the vehicle is stationary or moving for those applications in which the engine is used in a vehicle having a PTO mode.

Figure 2:
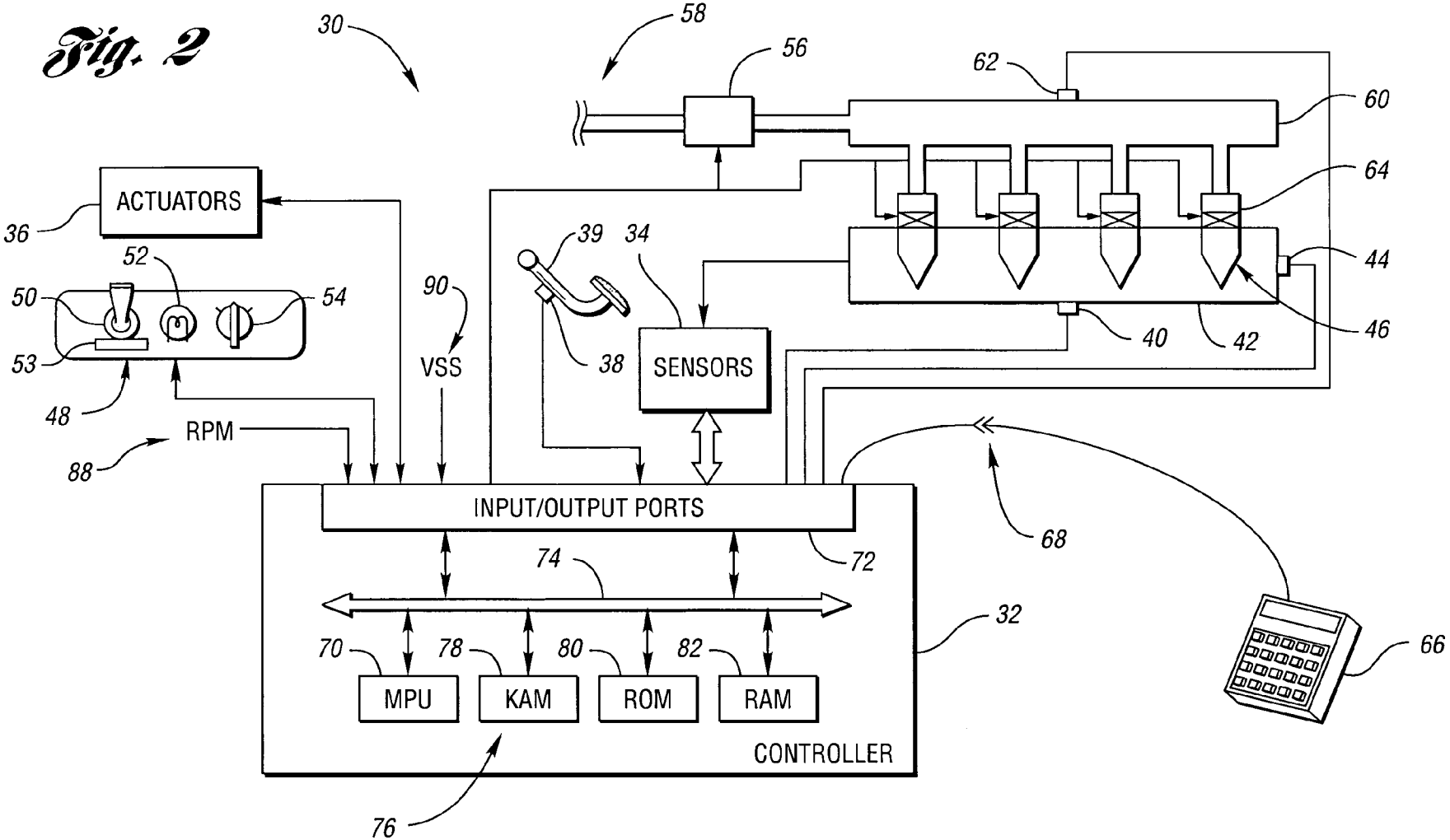
FIG. 2 is a diagrammatic and schematic view of a control system used in the vehicle of FIG. 1.

Referring now to FIG. 2, a block diagram illustrating an engine control system 30 with engine overspeed protection by inhibiting operator throttle input according to the present invention is shown. System 30 represents the control system for engine 10 of FIG. 1. System 30 preferably includes a controller 32 in communication with various sensors 34 and actuators 36. Sensors 34 may include various position sensors such as a pedal position sensor 38, that may be coupled to an accelerator pedal 39 (as shown) or a brake pedal. Likewise, sensor 34 may include a coolant temperature sensor 40 which provides an indication of the temperature of engine block 42. Likewise, an oil pressure sensor 44 is used to monitor engine operating conditions by providing an appropriate signal to controller 32. Other sensors may include rotational sensors to detect the rotational speed of the engine, such as RPM sensor 88 and a vehicle speed sensor (VSS) 90 in some applications. VSS 90 provides an indication of the rotational speed of the output shaft or tailshaft of a transmission (not shown) which may be used to calculate the vehicle speed. VSS 90 may also represent one or more wheel speed sensors which are used in anti-lock braking system (ABS) applications, for example, also controlled by the ECM 32.

Actuators 36 include various vehicle components which are operated via associated control signals from controller 32. As indicated in FIG. 2, various actuators 36 may also provide signal feedback to controller 32 relative to their operational state, in addition to feedback position or other signals used to control actuators 36. Actuators 36 preferably include components related to engine compression braking in addition to as well as a plurality of fuel injectors 46 which are controlled via associated solenoids 64 to deliver fuel to the corresponding cylinders. In one embodiment, controller 32 controls a fuel pump 56 to transfer fuel from a source 58 to a common rail or manifold 60. Operation of solenoids 64 controls delivery of the timing and duration of fuel injection as is well known in the art. While the representative control system of FIG. 2 with associated fueling subsystem illustrates the typical application environment of the present invention, the invention is not limited to any particular type of fuel or fueling system.

Sensors 34 and actuators 36 may be used to communicate status and control information to an engine operator via a console 48. Console 48 may include various switches 50 and 54 in addition to indicators 52. Console 48 is preferably positioned in close proximity to the engine operator, such as in the cab of a vehicle. Indicators 52 may include any of a number of audio and visual indicators such as lights, that may be displayed or illuminated as a response to detection of engine operation in a speed range deemed undesirable, including displays, buzzers, alarms, and the like. Preferably, one or more switches, such as switch 50 and switch 54, are used to request a particular operating mode, such as cruise control or PTO mode, for example.

In one embodiment, controller 32 includes a programmed microprocessing unit 70 in communication with the various sensors 34 and actuators 36 via input/output port 72. As is well known by those of skill in the art, input/output ports 72 provide an interface in terms of processing circuitry to condition the signals, protect controller 32, and provide appropriate signal levels depending on the particular input or output device. Processor 70 communicates with input/output ports 72 using a conventional data/address bus arrangement. Likewise, processor 70 communicates with various types of computer-readable storage media 76 which may include a keep-alive memory (KAM) 78, a read-only memory (ROM) 80, and a random-access memory (RAM) 82. The various types of computer-readable storage media 76 provide short-term and long-term storage of data used by controller 32 to control the engine. Computer-readable storage media 76 may be implemented by any of a number of known physical devices capable of storing data representing instructions executable by microprocessor 70. Such devices may include PROM, EPROM, EEPROM, flash memory, and the like in addition to various magnetic, optical, and combination media capable of temporary and/or permanent data storage.

Computer-readable storage media 76 include data representing program instructions (software), calibrations, operating variables, and the like used in conjunction with associated hardware to control the various systems and subsystems of the engine and/or vehicle. The engine/vehicle control logic is implemented via controller 32 based on the data stored in computer-readable storage media 76 in addition to various other electric and electronic circuits (hardware).

In the preferred embodiment of the present invention, controller 32 includes control logic to detect engine overspeed operation, for example, by comparing sensed, actual engine speed to a programmed threshold engine speed that may be selected as desired. Control logic implemented by controller 32 monitors operating speed of the engine, transmission, or other powertrain connected components. Likewise, the detector 88 determines an indication that the engine speed is above the threshold speed limit. Controller 32 then receives input from sensor 38 that accelerator pedal 39 is engaged by the operator. The controller 32 then automatically adjusts the engine operating mode or powertrain functions to limit operation above the engine speed threshold and control the speed of the vehicle. Of course, depending upon the particular application, one or more thresholds may be selected for monitoring.

As used throughout the description of the invention, a selectable or programmable limit or threshold may be selected by any of a number of individuals via a programming device, such as device 66 selectively connected via an appropriate plug or connector 68 to controller 32. Rather than being primarily controlled by software, the selectable or programmable limit may also be provided by an appropriate hardware circuit having various switches, dials, discrete components and the like. Of course, the selectable or programmable limit may also be changed using a combination of software and hardware without departing from the spirit of the present invention.

As will be appreciated by persons of skill in the art, control logic may be implemented or effected in hardware, software, or a combination of hardware and software. The various functions are preferably effected by a programmed microprocessor, such as included in the DDEC controller manufactured by Detroit Diesel Corporation, Detroit, Mich. Of course, control of the engine/vehicle may include one or more functions implemented by dedicated electric, electronic, or integrated circuits. As will also be appreciated by those of skill in the art, the control logic may be implemented using any of a number of known programming and processing techniques or strategies and is not limited to the order or sequence illustrated or described. For example, interrupt or event driven processing is typically employed in real-time control applications, such as control of an engine or vehicle. Likewise, parallel processing, multi-tasking, or multi-threaded systems and methods may be used to accomplish the objectives, features, and advantages of the present invention. The invention is independent of the particular programming language, operating system, processor, or circuitry used to develop and/or implement the control logic illustrated. Likewise, depending upon the particular programming language and processing strategy, various functions may be performed in the sequence illustrated, at substantially the same time, or in a different sequence while accomplishing the features and advantages of the present invention. The illustrated functions may be modified, or in some cases omitted, without departing from the spirit or scope of the present invention.

Figure 3:
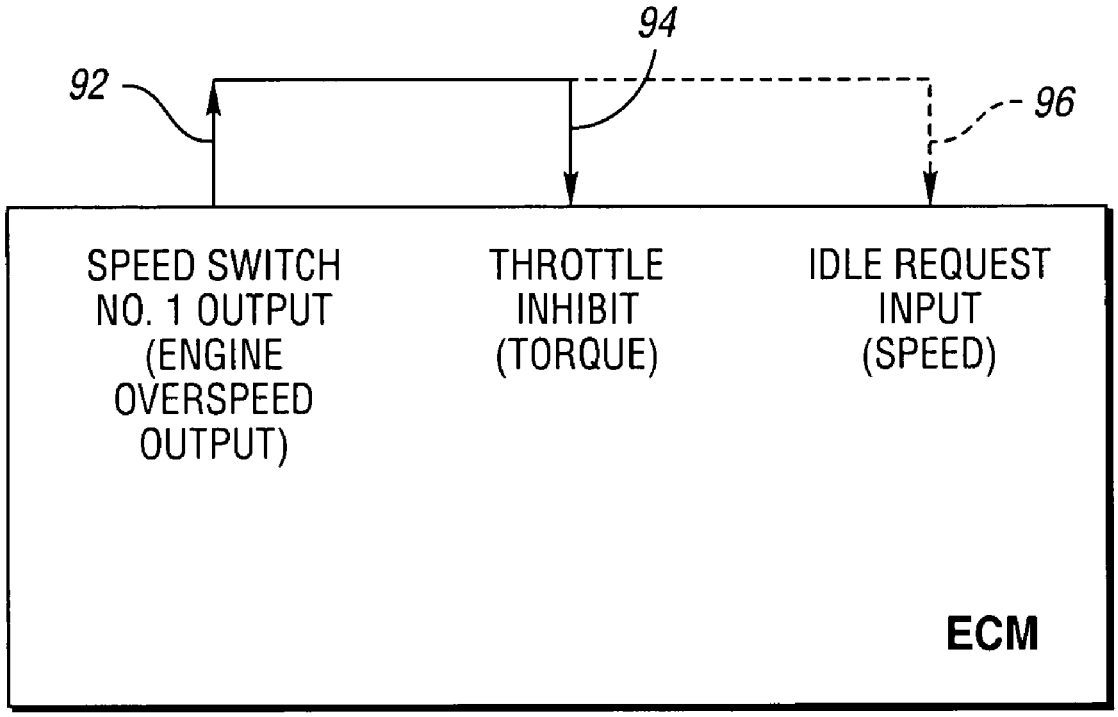
FIG. 3 is a diagrammatic and schematic representation of the control with parts removed for the sake of clarity.

As best shown in FIG. 3, the method of the present invention may be most conveniently incorporated in a programmable electronic control unit, for example a DDEC 4 controller of Detroit Diesel Corporation. In particular, such controls include digital outputs, for example a starter lockout or overspeed indicator function outputs that switch in response to programmed, threshold value being attained as indicated by the related sensor. For example, the output signal enable and disable thresholds may be programmed, and set as engineering experience may determine. The application code system sets the default function, number and polarity for programming each of the digital input ports and digital output ports. The function of the output ports may be ordered at the time of engine order or configured by a vehicle electronic program system (VEPS) tool or a distributor reprogramming system (DRS) tool. Similarly, the RPM values or the polarity can be set as desired.

As shown in FIG. 3, the controller enables the digital output 92 when the actual engine speed meets or exceeds the programmed engine overspeed threshold, for example 2300 rpm. The output 92 is coupled to the digital input 94, for example, the output 92 and the input 94 may be clamped to ground, when the overspeed threshold is detected, although the polarity can be programmed as desired. The input 94 of the preferred embodiment may be a torque based governor for control of fuel delivery limited by torque output of the engine. An alternative as shown in phantom line at 96 may be a speed-based governor limiting fuel delivery on the basis of engine speed output. Nevertheless, if the operator maintains throttle actuation, even though the vehicle has crested the hill and begins a downward descent at which engine braking is required, the overspeed indicator controls a throttle inhibit signal so that the throttle actuation point is no longer enabled to control, for example, fuel feed to the engine. In addition to grounding the input and enabling the throttle inhibit function to override the operator throttle requests, the control enables engine compression braking, provided that the other criteria such as the engine brake switch on, clutch release switch off, local torque is not zero conditions, are satisfied for engine brake operation.

It may also be understood that software logic may be modified to allow engine braking at some threshold above rated speed regardless of the throttle position. In addition, a device could send an inhibit fueling message command via digital communication link such as SAE J1939 or J1922.

Having thus described the present invention, many modifications may become apparent to those skilled in the art to which it pertains without departing from the scope and spirit of the present invention as defined in the appended claims.

What is claimed is:

1. A method for controlling operating of a compression ignition vehicle engine with an electronic control module and a throttle control by limiting response to throttle actuation determined to be undesirable, comprising:

sensing when said engine is in overspeed operation;

responding to said sensing said engine overspeed operation by inhibiting response to throttle control actuation; and enabling engine compression braking of said vehicle when said overspeed operation is maintained beyond said responding.

2. The invention as described in claim 1 wherein said enabling comprises commanding a reduced engine speed.

3. The invention as described in claim 2 wherein said commanding is a fuel adjustment command.

4. The invention as described in claim 1 wherein said commanding comprises commanding a powertrain response.

5. The invention as described in claim 1 wherein said responding comprises automatically switching a digital input to said electronic control module.

6. An engine control for a vehicle with a compression-ignition internal combustion engine that switches engine operation out of a speed range defined between first and second thresholds, the control comprising:

a sensor detecting when said engine operation passes an overspeed threshold during actuation of the throttle;

a controller input responsive to said detecting for processing a predetermined response of inhibiting response to throttle actuation; and a controller command enabling engine compression braking when said overspeed condition is maintained after said detecting.

7. The invention as described in claim 6 wherein said control comprises a discrete component circuit generating said input to an electronic control module.

8. The invention as described in claim 6 wherein said control comprises a software program in an electronic control module.

9. A computer readable storage medium having data stored therein representing instructions executable by a computer to control a compression ignition internal combustion engine installed in a vehicle to perform a speed control feature, the computer readable storage medium comprising:

instructions for detecting when engine overspeed threshold occurs during throttle actuation;

instructions for responding to said detecting by inhibiting response to the actuation; and instructions for commanding reduced vehicle speed by engine compression braking.

10. The invention as described in claim 9 wherein said storage medium comprises instructions including commands for at least one engine operating parameter.

11. The invention as described in claim 10 wherein said instructions include commands for at least one powertrain parameter.

* * * * *